US007047187B2

(12) United States Patent
Cheng et al.

(10) Patent No.: US 7,047,187 B2
(45) Date of Patent: May 16, 2006

(54) METHOD AND APPARATUS FOR AUDIO ERROR CONCEALMENT USING DATA HIDING

(75) Inventors: Szeming Cheng, College Station, TX (US); Hong Heather Yu, Princeton Jct., NJ (US); Zixiang Xiong, College Station, TX (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 677 days.

(21) Appl. No.: 10/083,886

(22) Filed: Feb. 27, 2002

(65) Prior Publication Data

US 2003/0163305 A1 Aug. 28, 2003

(51) Int. Cl.
*G10L 19/04* (2006.01)

(52) U.S. Cl. ..... 704/219; 704/200.1; 704/500

(58) Field of Classification Search ..... 704/200.1, 704/219–223, 229–230, 500–503; 714/747; 382/240; 375/262
See application file for complete search history.

(56) References Cited

U.S. PATENT DOCUMENTS

| | | | | |
|---|---|---|---|---|
| 5,233,629 | A * | 8/1993 | Paik et al. | 375/262 |
| 5,943,347 | A * | 8/1999 | Shepard | 714/747 |
| 6,714,683 | B1 * | 3/2004 | Tian et al. | 382/240 |
| 6,725,192 | B1 * | 4/2004 | Araki | 704/230 |
| 6,778,953 | B1 * | 8/2004 | Edler et al. | 704/200.1 |

* cited by examiner

*Primary Examiner*—Wayne Young
*Assistant Examiner*—Huyen X. Vo
(74) *Attorney, Agent, or Firm*—Harness, Dickey & Pierce, PLC

(57) ABSTRACT

A method for concealing errors in an audio signal includes digitally encoding the audio signal into a plurality of audio data packets representative of the audio signal; determining a perceptually tolerable distortion limit for the audio packets; and altering a value of at least one audio packet by an amount within the perceptually tolerable distortion limit utilizing information representative of a different audio data packet.

34 Claims, 7 Drawing Sheets

METHOD AND APPARATUS FOR AUDIO ERROR CONCEALMENT USING DATA HIDING

FIELD OF THE INVENTION

The present invention relates methods and apparatus for digitally encoding and decoding audio, and more particularly to methods and apparatus for embedding error concealment data in a digitally encoded audio signal with little or no perceptually noticeable distortion, and of utilizing the error concealment data to estimate corrupt portions of the audio signal.

BACKGROUND OF THE INVENTION

It is well-known that media data is, to different degrees, vulnerable to channel errors when transmitted through an imperfect communication channel. For example, chunks of data may be lost due to transmission errors. One known method used to conceal the effects of data blocks transmission errors relies upon estimating or interpolating contents of lost blocks utilizing relationships between this content and the content of neighboring blocks. However, estimation and interpolation methods do not comprehend the actual content of lost data blocks, and the effectiveness of these methods decreases as the distance between a lost block and the available neighboring blocks increases. Thus, audible artifacts can often be detected after recovery.

Reliable transmission of digital audio over packet-switched networks such as the Internet that offer no quality of service (QoS) guarantee is a challenging task. Although channel coding can be used to protect the audio from packet loss, this type of protection increases the payload and thus requires extra bandwidth to transmit the audio stream. On the other hand, known methods of error concealment extract features from the received audio for use in the recovery of lost data. Error concealment methods are attractive because perceptual audio quality is improved without the need for additional payload.

By extracting audio features from an audio stream at an encoder and transmitting these features to a decoder along with the audio stream, both the computational complexity of receivers for error concealment and inaccuracies in the extraction of enhancement features by decoders can be reduced. Such transmission methods, however, suffer from many of the same disadvantages of channel coding and may not be useful at all because the feature transmission stream similarly increases the payload. Not only does the extra payload require increased bandwidth, but the extra payload also necessarily modifies the audio format if neither a common area nor a user data area is available. Because of the required format change, ordinary decoders can no longer decode the audio stream.

SUMMARY OF THE INVENTION

One configuration of the present invention therefore provides a method for concealing errors in an audio signal. This configuration includes digitally encoding the audio signal into a plurality of audio data packets representative of the audio signal; determining a perceptually tolerable distortion limit for the audio packets; and altering a value of at least one audio packet by an amount within the perceptually tolerable distortion limit utilizing information representative of a different audio data packet.

Another configuration of the present invention provides a method for concealing errors in an audio signal. This configuration includes decoding a digitally encoded audio signal, wherein the digitally encoded audio signal includes a plurality of audio data packets representative of the audio signal, and the plurality of audio data packets includes a plurality of altered audio data packets. Each altered audio data packet includes an alteration indicative of information representative of a different audio data packet, and each alteration is limited to a predetermined perceptually tolerable distortion limit. Also included in this configuration are determining that at least one audio data packet is missing or unavailable from the digitally encoded audio signal; extracting information representative of the missing or unavailable audio data packet from an alteration of at least one different, available audio data packet; and utilizing the extracted information to estimate the missing or unavailable audio data packet.

Yet another configuration of the present invention provides an apparatus for concealing errors in an audio signal. This apparatus is configured to digitally encode the audio signal into a plurality of audio data packets representative of the audio signal; and, utilizing a determined perceptually tolerable distortion limit for the audio packets, alter a value of at least one audio packet by an amount within the perceptually tolerable distortion limit utilizing information representative of a different audio data packet.

Still another configuration of the present invention provides an apparatus for concealing errors in an audio signal. This apparatus is configured to decode a digitally encoded audio signal. The digitally encoded audio signal includes a plurality of audio data packets representative of the audio signal, and the plurality of audio data packets includes a plurality of altered audio data packets. Each of the altered audio data packets includes an alteration indicative of information representative of a different audio data packet, and each the alteration is limited to a predetermined perceptually tolerable distortion limit. The apparatus is also configured to determine when an audio data packet is missing or unavailable from the digitally encoded audio signal; extract information representative of the missing or unavailable audio data packet from an alteration of at least one different, available audio data packet; and utilize the extracted information to estimate the missing or unavailable audio data packet.

Yet another configuration of the present invention provides a machine readable medium having recorded thereon instructions configured to instruct a computer to digitally encode the audio signal into a plurality of audio data packets representative of the audio signal; and, utilizing a determined perceptually tolerable distortion limit for the audio packets, alter a value of at least one audio packet by an amount within the perceptually tolerable distortion limit utilizing information representative of a different audio data packet.

Still another configuration of the present invention provides a machine readable medium having recorded thereon instructions configured to instruct a computer to decode a digitally encoded audio signal. The digitally encoded audio signal includes a plurality of audio data packets representative of the audio signal, and the plurality of audio data packets includes a plurality of altered audio data packets. Each altered audio data packet includes an alteration indicative of information representative of a different audio data packet, and each alteration is limited to a predetermined perceptually tolerable distortion limit. The recorded instructions also include instructions to determine when at least one audio data packet is missing or unavailable from the digitally encoded audio signal; extract information representative of the missing or unavailable audio data packet from an alteration of at least one different, available audio data packet; and utilize the extracted information to estimate the missing or unavailable audio data packet.

Configurations of the present invention provide error concealment in audio files or streams in which data is missing or otherwise unavailable. In addition, the concealed data in the audio files or streams provides little or no perceptual degradation relative to an audio file or stream not having concealed data, when the audio file or stream is decoded by a decoder that does not provide error concealment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

As used herein, an audio data packet is "missing or unavailable" when it is sequentially required for decoding an encoded audio signal. For example, a packet may be missing or unavailable if it is dropped or lost during transmission, delayed in transmission beyond the time at which it is needed for decoding, or corrupted. Also as used herein, the recitation of a "first" element and a "second" element, etc., does not necessarily imply, by itself, an order of time or importance of the recited elements. However, neither is such recitation intended to exclude such ordering, if required by further context.

In one configuration of the present invention, data hiding is utilized to recover missing data chunks, such as a missing packet of an audio signal. Some audio content information for each audio packet is hidden in at least one other packet of an audio data stream. When data recovery is needed, the content of a lost packet is extracted from the hidden portion of non-corrupted packets of the audio data stream. Neighborhood interpolation and/or estimation is also used, in one embodiment, to further enhance the concealment effect.

Figure 1:
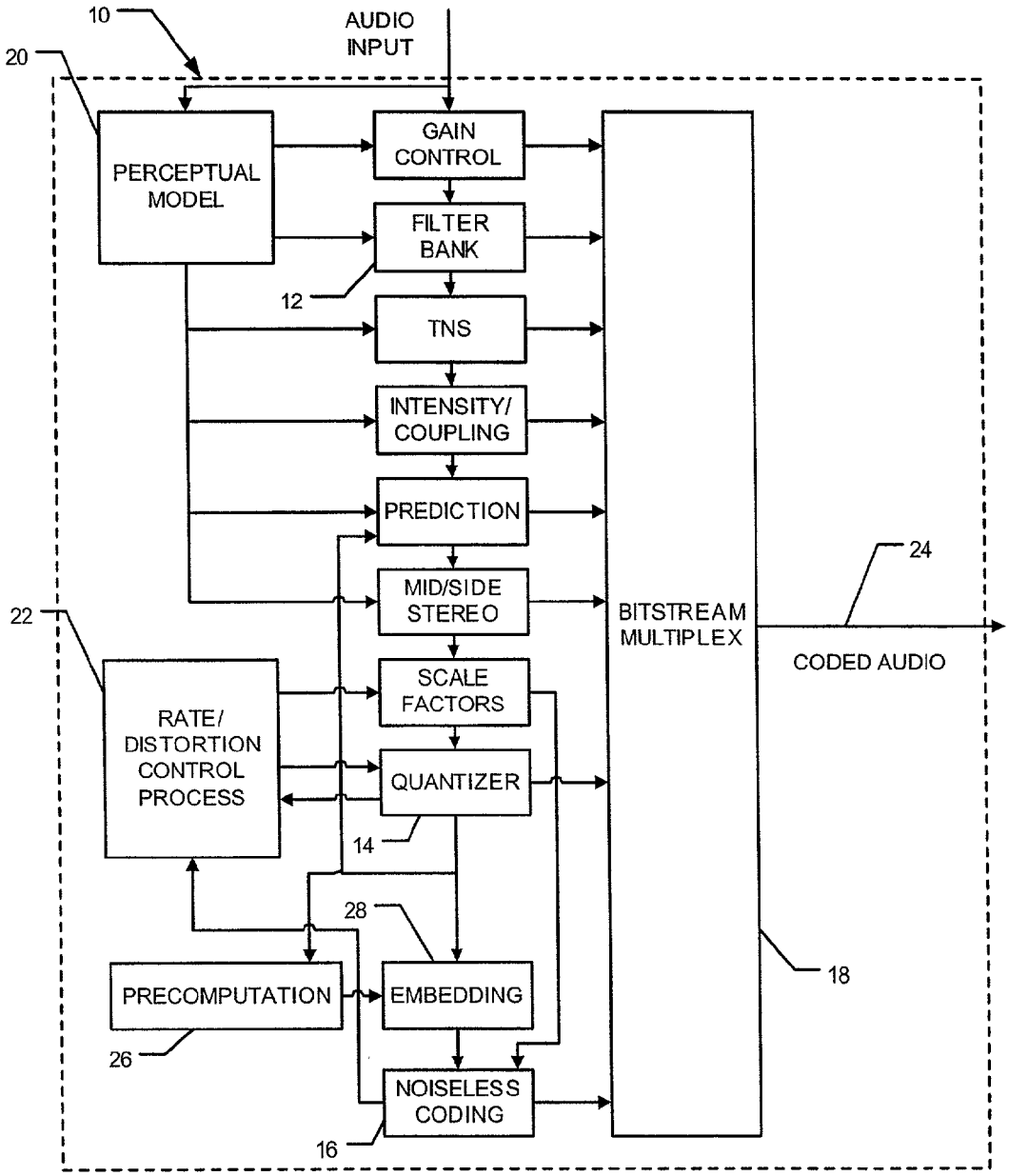
FIG. 1 is a block diagram of one configuration of an encoder of the present invention.

For example, in one configuration of an audio encoder 10 and referring to FIG. 1, error concealment is achieved by watermarking a standard MPEG-2 advanced audio coded (AAC) audio stream. In this configuration, encoder 10 is a modified MPEG-2 AAC encoder that includes a number of functional blocks used in a standard MPEG-2 AAC encoder, such as frequency transform 12; quantization 14; entropy (noiseless) coding 16; and bitstream multiplexing 18. Filter bank or frequency transform block 12 employs a modulated discrete cosine transform (MDCT) typically with 1024 samples per frame to digitally encode an audio signal into a plurality of audio data packets representative of the audio signal. The 1024 frequency samples in the each time frame are separated into 49 frequency bands. Within each frequency band, samples are considered to have similar perceptual effect to human ears and thus share the same quantization step size. Perceptual modeling 20 is applied to the MDCT coefficients to estimate the maximum amount of distortion that can be withstood by each coefficient. The quantization 14 step size is iteratively modified by rate/distortion control 22 until both the bit rate is below a target bit rate and distortion is below a maximum acceptable value obtained from perceptual model 20. Huffman coding 16 is used to encode the quantized coefficients and the quantization step size. The coded indices are multiplexed 18 into a single bit stream 24. Bit stream 24 is transferred to an audio decoder using a packet-switched network such as the Internet.

Figure 2:
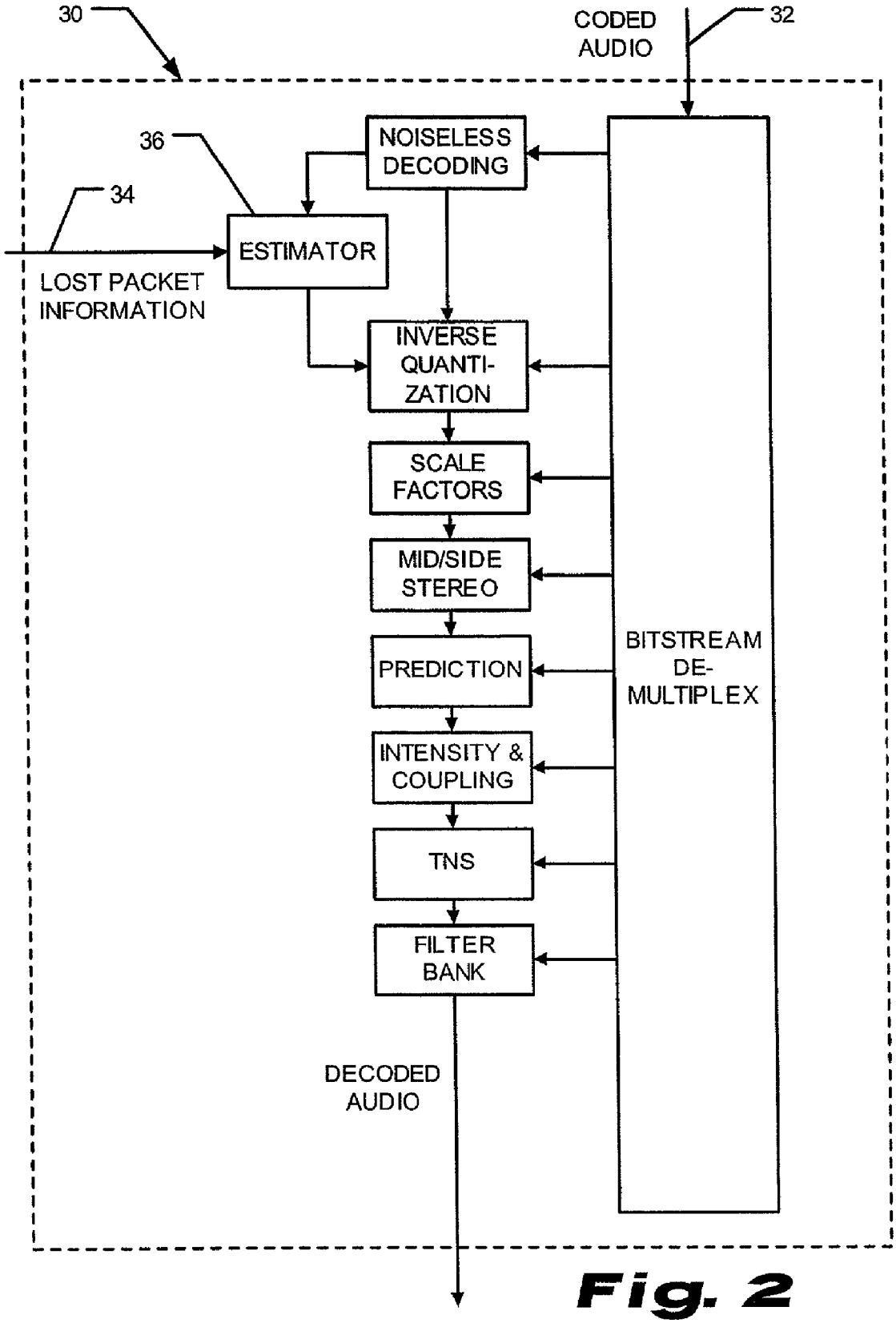
FIG. 2 is a block diagram of one configuration of a decoder of the present invention.

Coefficients produced by filter bank 12 inside a frequency band share similar perceptual behavior. Therefore, in one configuration of the present invention, coefficients are grouped together for estimation. In one configuration and referring to FIG. 2, a modified MPEG-2 AAC audio decoder 30 receives an input bit stream 32 that is received via a packet switched network (e.g., the Internet) from decoder 10. Some packets are lost during transmission, but the packet switching protocol (e.g., Internet Protocol or IP) permits an identification of the packets that have been lost to be made. Lost packet information 34 is provided to decoder 30 in any fashion that allows lost data in decoder 30 to be identified by estimator 36. Lost packet information is readily obtained, for example, by analyzing the arriving incoming packet stream, when the stream is communicated via the Internet.

Denote the (n,i)-band as the $i^{th}$ band at the $n^{th}$ time frame. Let us assume by way of example that coefficients b[n,k] in (n,i)-band are lost, where $k \in K_i$, and $K_i$ is the index set of the $i^{th}$ band. In one embodiment, estimator 36 estimates coefficient b[n, k] as either $\hat{b}_0[n,k]=0$, $\hat{b}_1[n,k]=b[n-1,k]$, $\hat{b}_2[n,k]=b[n+1,k]$, or $\hat{b}_3[n,k]=\frac{1}{2}(b[n-1,k]+b[n+1,k])$.

In one configuration of the present invention in which it has been predetermined that embedding two bits of information in a band comprising the audio data packets is within a perceptually tolerable distortion limit for the packets, and referring again to FIG. 1, precomputation block 26 precomputes c[n,i] corresponding to each of the above four choices $\hat{b}_0$, $\hat{b}_1$, $\hat{b}_2$, and $\hat{b}_3$ and selects that c[n,i] which minimizes mean square error for the $i^{th}$ band at the $n^{th}$ time frame. Embedding block 28 embeds this selected c[n,i] into the original AAC audio bit stream. More particularly, the selected index c[n,i] that is embedded is written:

$$c[n, i] = \text{argmin}_{c\in\{0,1,2,3\}} \sum_{k\in K_i} \left(b[n, k] - \hat{b}_c[n, k]\right)^2$$

where $\text{argmin}_{c\in\{0,1,2,3\}}$ denotes the value of the index c from the set {0, 1, 2, 3} that minimizes the value of the argument, written here as $$\sum_{k\in K_i} \left(b[n, k] - \hat{b}_c[n, k]\right)^2.$$

Preferably, the selected c[n,i] is not embedded into the (n,i)-band itself, because when this information is needed, the band would be lost as would c[n,i]. Instead, in one configuration, the selected index c[n,i] for the $i^{th}$ band at the $n^{th}$ time frame is split into two bits and embedded separately into two neighboring bands. Thus, $$d[n, i] = \begin{cases} 0, & \text{if } c[n-1, i] \in \{0,1\} \wedge c[n+1, i] \in \{0,2\}, \\ 1, & \text{if } c[n-1, i] \in \{2,3\} \wedge c[n+1, i] \in \{0,2\}, \\ 2, & \text{if } c[n-1, i] \in \{0,1\} \wedge c[n+1, i] \in \{1,3\}, \\ 3, & \text{if } c[n-1, i] \in \{2,3\} \wedge c[n+1, i] \in \{1,3\}, \end{cases}$$

which alters a value of at least one audio packet by an amount less than the predetermined perceptually tolerable distortion limit, utilizing information representative of a different audio packet. The process is repeated so that a plurality of audio packets are altered, each utilizing information representative of a different audio packet than the one being altered.

Estimator 36 in audio decoder 30 uses the higher and the lower bit of d[n,i] to determine whether the current band i is suitable for estimating the band in the next time frame ((n+1,i)-band) and in the previous time frame ((n−1,i)-band), respectively. For example, if the (n,i)-band were lost, from the lower bit of d[n+1,i] and the higher bit of d[n−1,i], estimator 36 determines whether the current band can be estimated from any of its neighboring time frames. When the current band is estimated from both neighboring time frames, it is scaled by ½. If one of its neighboring time frames is lost, the current band is estimated from the remaining neighbor. If both neighboring time frames are lost, then estimator 36 provides the default assumption that c[n,i]=0 and the coefficients are replaced by zeros.

Although not required for practicing this invention, it is advantageous for bitstream multiplexer 18 to utilize a packing rule that is most likely to increase the effectiveness of the estimates of lost coefficients. The most effective estimates of lost coefficients are those that utilize the nearest neighbors of the lost coefficient. Thus, in one configuration of the present invention, bitstream multiplexer 18 does not pack together adjacent coefficients along both time and frequency axes. By not packing together the adjacent coefficients, this configuration avoids the loss of estimation sources when a packet is dropped, thus providing greater assurance that estimator 36 will be able to utilize nearest neighbors for estimates of lost coefficients. Also in one configuration, estimation and/or interpolation of coefficients is used for additional error control.

Fragile digital watermarking (or hereinafter, "fragile watermarking") is commonly defined as any watermarking method that is sensitive to any modifications to an encoded data stream. For purposes herein, any watermarking method that has an embedding rate sufficiently high (e.g., 1000 bits/sec for audio) will be sufficiently sensitive to modifications in an encoded data stream to be considered "fragile." There are two bits for each d[n,i] and one d[n,i] per band in one configuration discussed above. Thus, for a dual channel audio clip with sampling rate 44100 Hz, the embedding rate is about 44100/1024×49×2×2≈8 kbits/sec.

One type of fragile watermarking method is least bit modulation (LBM). One example of LBM is the embedding of a bit into a host signal by replacing the least significant bit of a signal sample with a corresponding embedded bit. LBM has not been found suitable for copyright protection because it can easily be removed by simple truncation. However, deliberate attacks on error concealment coding are generally not likely. Embedding rates can also be quite high. For example, a bit can be embedded into each sample of a dual channel audio signal sampled at a rate of 44100 Hz, resulting in an embedding rate up to 44100×2≈80 kbit/sec.

It is desirable to adaptively select embedding locations for LBM because different signal samples may have different susceptibilities to distortion. However, in error concealment applications, side-information that could be used by decoder 30 to identify the embedding locations is usually not transmitted, nor are decoding keys generally made available. Therefore, in one configuration, both encoder 10 (more particularly, embedding block 28) and decoder 30 (more particularly, estimator 36) utilize predefined embedding locations.

In another configuration of the present invention, a fragile watermarking method is used that does not require decoder 30 to have knowledge of exact embedding locations. For an arbitrary host signal sequence $x=x_1,x_2, \ldots ,x_N$, embedding block 28 of encoder 10 embeds an integer $k\in[0,K]$ selected so that:

$$\sum_{i=1}^{n} x_i \equiv k \bmod K.$$

LBM is a special case of this configuration in which N=1 and K=2.

There is more than one possible watermarked signal containing the same embedded information. Therefore, in one configuration, encoder 10 is configured to select locations of modifications so that the watermarked signal is perceptually closest to the original signal. Satisfactory results are obtained with this encoder 10 configuration even when used in conjunction with configurations of decoder 30 that lack knowledge of the locations at which modifications have been made.

Audio encoders that utilize fragile watermarking employ embedding blocks 28 that insert the watermark data after quantization, to prevent the watermark data from being destroyed. To make it easier to embed watermark information into an AAC coded signal or an otherwise compressed signal, one configuration of the present invention embeds watermark data into quantization indices that are obtained after partial decoding. After watermarking, the modified indices are Huffman encoded by encoder 16 without modification of the original codebook.

Perceptual modeling 20 of the original audio signal is used in one configuration of the present invention to determine which indices are to be modified and how much they are to be modified. For example, assume that a particular coefficient is known to survive a distortion level of 10 units without a significant adverse effect on perceived audio quality, and that the current quantization step size of the coefficient is 2 units. Where uniform quantization is used, the corresponding index can thus be varied by 5 steps without significantly affecting the perceived quality.

In one configuration, the audio file is compressed before information is embedded using modulo watermarking. Because of the compression, perceptual model 20 is not accessible. Although it is possible to estimate model parameters from the decompressed audio, one configuration of the present invention employs a heuristic method to achieve improved accuracy without the use of perceptual model 20.

Figure 3:
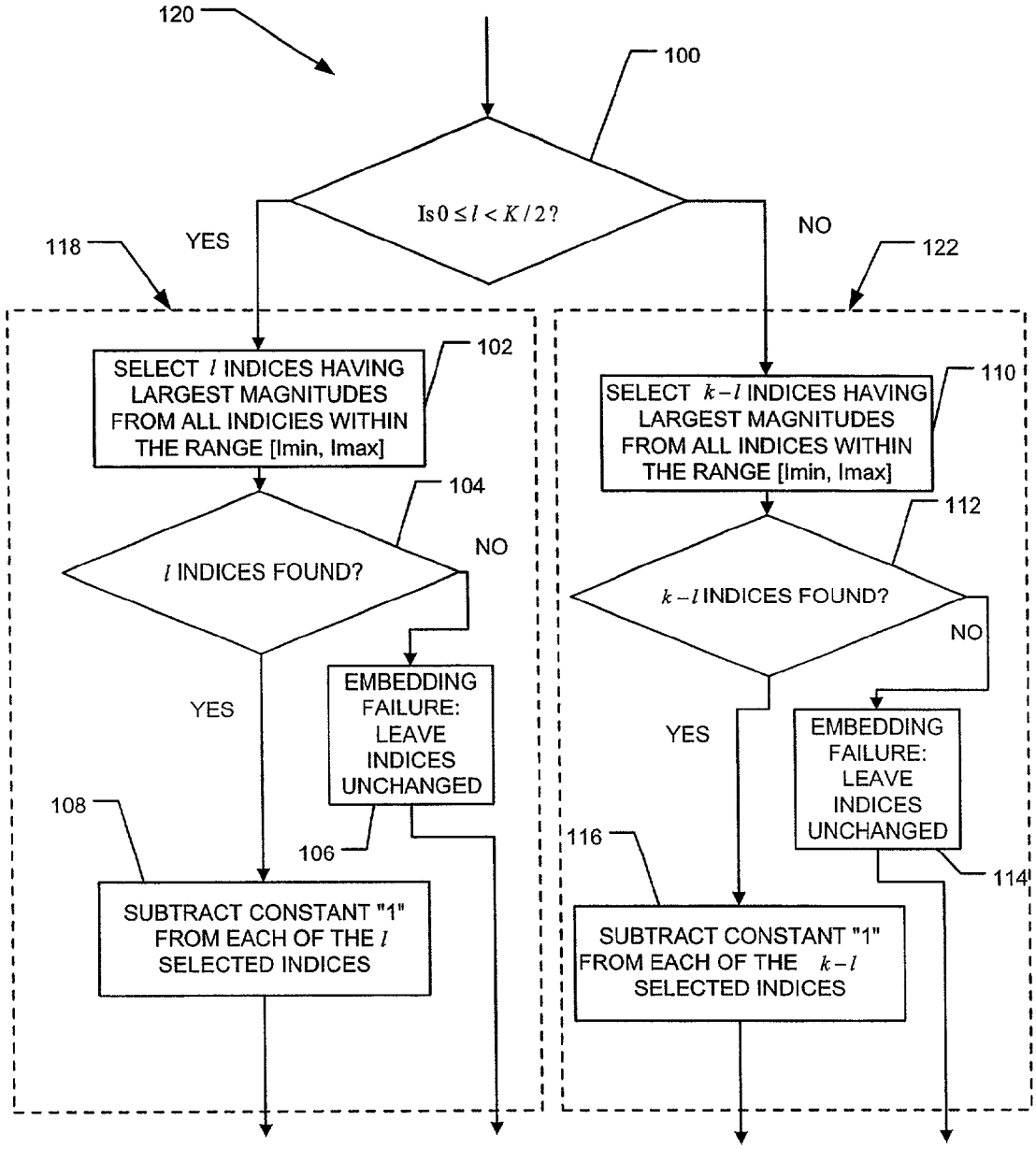
FIG. 3 is a flow chart of a configuration of an encoding method of the present invention.

More particularly, in this configuration, precomputation block 26 computes d[n,i] which is embedded by embedding block 28 into quantization indices q[n,k] of (n,i)-band, $k \in K_i$, where q[n,k] is a quantized version of b[n,k]. Let $l \equiv \Sigma_{k \in K_i} q[n,k] - d[n,i] \bmod K$, where K is the number of different values that can be embedded. For example, in one embodiment, K is chosen as 4. Referring to FIG. 3, if embedding block 28 determines 100 that $0 \leqq l < K/2 = 2$, embedding block 28 selects 102 the l indices having the largest magnitudes from all indices that lie within range $[I_{min}, I^{max}]$. If fewer than l indices are found 104, embedding block 28 declares 106 an embedding failure and leaves the indices unchanged. Otherwise, embedding block 28 subtracts 108 the constant value 1 from each of the l selected indices. On the other hand, if embedding block 28 determines 100 that $K > l \geqq K/2$, embedding block 28 selects 110 the k−l indices having the largest magnitudes from all indices that lie within range $[I_{min}, I_{max}]$ If fewer than k−l indices are found 104, embedding block 28 declares 106 an embedding failure and leaves the indices unchanged. Otherwise, embedding block 28 subtracts 108 the constant value 1 from each of the k−l selected indices. Note that branch 118 of method configuration 120 is similar to branch 122, except that the value k−l is substituted in branch 122 where l appears in branch 118. Whether the constant value 1 is subtracted in branch 118 and added in branch 122 or vice versa is an arbitrary choice, as long as the choice is consistent and the decoder design is consistent with this choice. One configuration of a fragile watermarking encoder that does not require decoder 30 to have knowledge of exact embedding locations has l=k, where k can be decoded as $$\hat{k} \equiv \sum_{i=1}^{N} x_i \bmod K.$$

Because the enhancement features (i.e., the d's) are independently stored, they are useful even when only a fraction of them are retrieved correctly. Thus, embedding failures can be tolerated if and when they occur.

The imposition of a lower limit $I_{min}$ restrains modification of small value indices, because small value indices are more likely to have high susceptibility to distortion. In particular, in one configuration of the present invention, no distortion is imposed on zero indices.

In one configuration of the present invention, satisfactory results were obtained with $I_{min}$ set to 1, but in other embodiments, $I_{min}$ is a design parameter that effects a trade-off between error free distortion and error concealment. For higher values of $I_{min}$, it is more likely that the embedding of d[n,i] will fail, leaving the indices with no distortion, at a cost of less effective error concealment.

$I_{max}$ in another configuration is equal to the maximum possible value available in the Huffman table minus 1 to prevent indices from being out of bound after modification. Large indices are selected for modification because they can withstand larger distortion.

Figure 4:
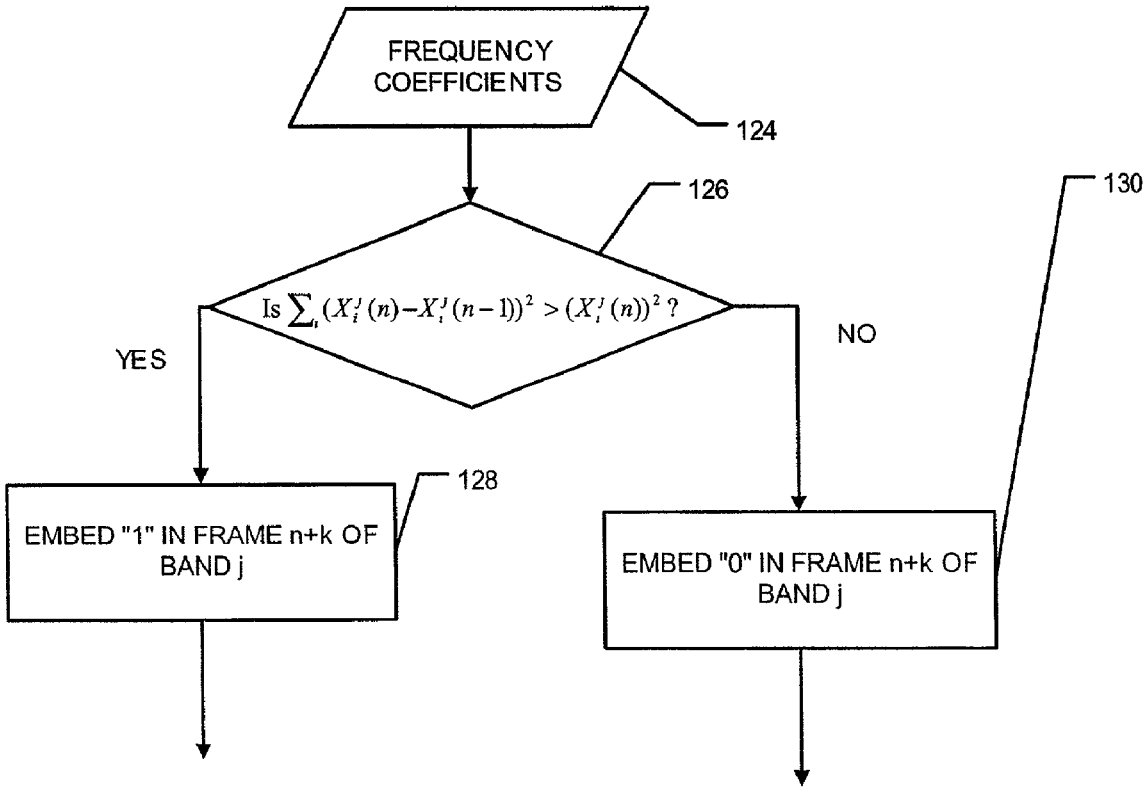
FIG. 4 is a flow chart of another configuration of an encoding method of the present invention.

In another configuration and referring to FIG. 4, $X_i^j(n)$ represents the ith coefficient of subband j in frame n generated by an encoder 10 encoding an audio stream. To embed hidden data that can be used by an audio decoder 30 to conceal errors due to lost data frames, frequency coefficients 124 are tested 126 to determine whether $\Sigma_i(X_i^j(n)-X_i^j(n-1))^2 > \Sigma_i(X_i^j(n))^2$. If so, a "1" is embedded 128 in frame n+k of band j; otherwise, a "0" is embedded 130 at that location. The embedded bits are referred to as bits B(j) for j=1,J, where j is the band in which the bit is embedded, and J is the number of bands. The number k is preselected in advance. For example, in one configuration, k=1.

Figure 5:
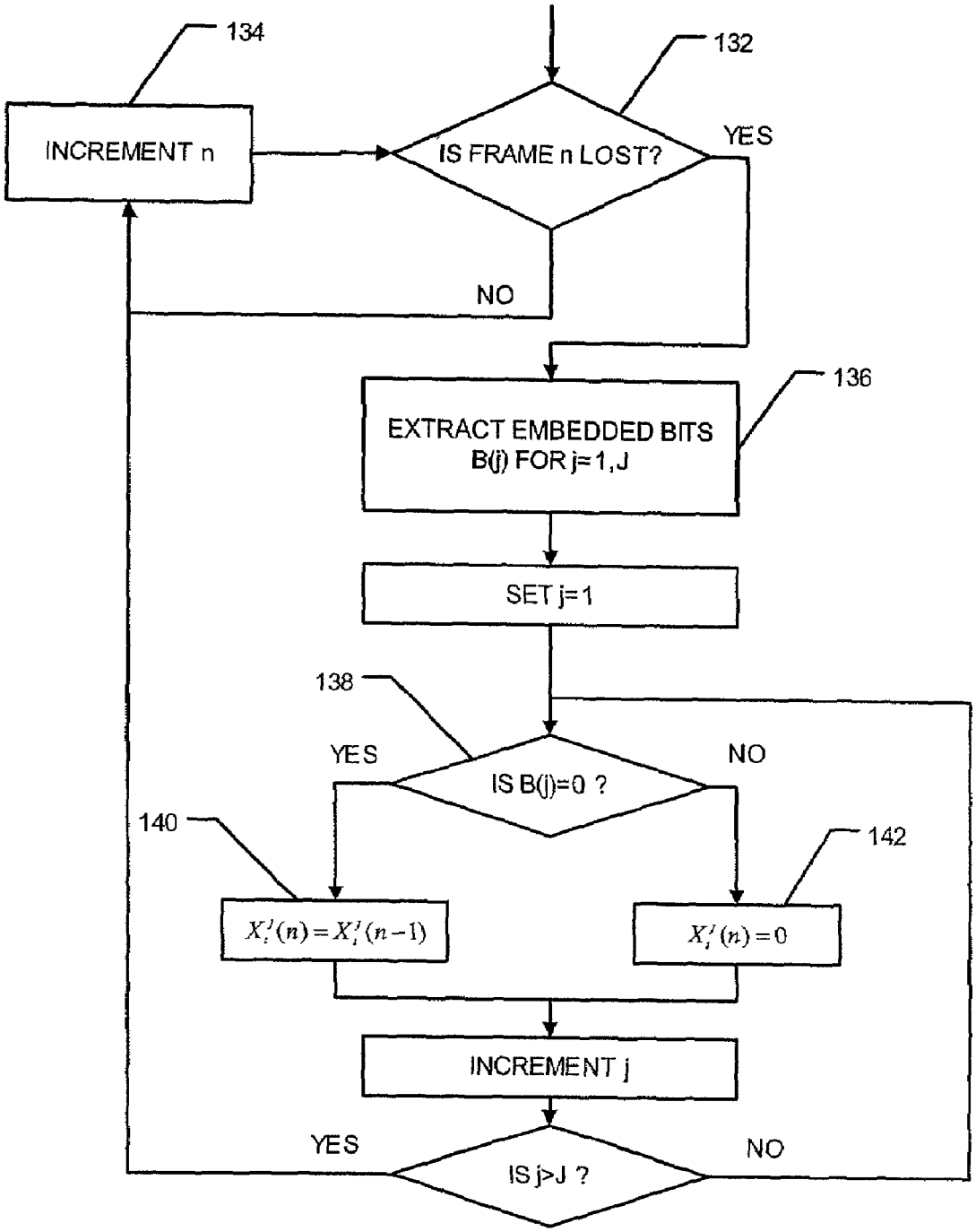
FIG. 5 is a flow chart of a configuration of a decoder of the present invention corresponding to the encoder of FIG. 4.

Referring to FIG. 5, an audio decoder 30 checks whether a frame n ready to be decoded is lost 132. If the frame is not lost, decoder 30 does not rely upon the hidden data for error concealment and advances 134 to the next frame to be decoded. However, when a frame n is lost, decoder 30 extracts 136, from frame n+k, the embedded bits B(j), where j=1,J. For each j, decoder 30 determines 138 whether B(j)=0. If so, decoder 30 sets 140 the decoded value $X_i^j(n)=X_i^j(n-1)$. Otherwise, decoder 30 sets 142 the decoded value $X_i^j(n)=0$. By setting the decoded value in accordance with the value of B(j), audio error concealment is provided in the frequency domain. In either case, decoding advances 134 to the next frame. In one configuration, an additional step comprising a conventional neighborhood interpolation is applied to the recovered audio to further refine the restored audio.

Although at least one configuration of the present invention embeds hidden bits into an audio signal utilizing least significant bit modulation, other data hiding methods can also be utilized, provided the data hiding bit rate is equal to or larger than one bit per band per frame.

Testing has been performed at various error rates (i.e., dropped packet rates) on music ranging from classical to rock and roll. It has been observed that the slight drop in signal to noise ratio that results from watermark embedding LSB watermark embedding is between about 0.03 dB and 0.68 dB, and is offset by a signal to noise ratio gain at packet loss ratios as low as 0.01 (i.e., one packet out of 100 lost). The signal to noise ratio gain becomes more conspicuous as the packet loss ratio rises. Furthermore, the signal to noise ratio increase of the recovered audio has been found to be higher than for other types of error control, such as silence filling in the time domain, frame repetition in the time domain, frame repetition in the frequency domain, and noise filling in the frequency domain. Moreover, the format of the digitally encoded audio data need not be altered by configurations of the present invention that alter only the values of the encoded audio data. Thus, relative to unaltered encoded audio data, little or no perceptual degradation is experienced when altered encoded audio data is decoded by an audio decoder that does not provide error concealment. More particularly, in the tested configurations, there was no perceptual degradation in the laboratory and office testing environment after the watermark was embedded in the original data stream.

The Huffman codebook utilized by coding block 16 is optimized for the AAC encoder. Because configurations of the present invention modifies indices but retain this codebook, it is expected that the size of a compressed MPEG-2 AAC audio file will increase after watermark embedding. However, because relatively few indices are changed, the increase should be small. Tests with seven different audio clips resulted in size increases of less than 0.1% in each case. On the other hand, if an 8 kbits/sec rate were used to write explicit overhead to the audio rather than to embed watermarks, the total file size would increase 8/256=3% for audio encoded at 256 kbits/sec.

Configurations of each audio encoder and audio decoder of the present invention may comprise both hardware and software (or firmware), and it is a design choice as to whether some or all of the functional blocks represented in each figure represent separate hardware components. For example, encoder 10 and decoder 30 can be implemented as special purpose signal processors. Alternately, encoder 10 can be implemented as a server computer with suitable software and signal processing hardware (e.g., an analog-to-digital converter). Also, decoder 30 can be implemented as a suitably programmed general-purpose computer equipped with an audio output device. Software comprising instructions for the computers comprising encoder 10 and/or decoder 30 to perform one or more of the method configurations described herein may be supplied on a machine-readable medium or downloaded electronically from another computer or storage device.

Figure 6:
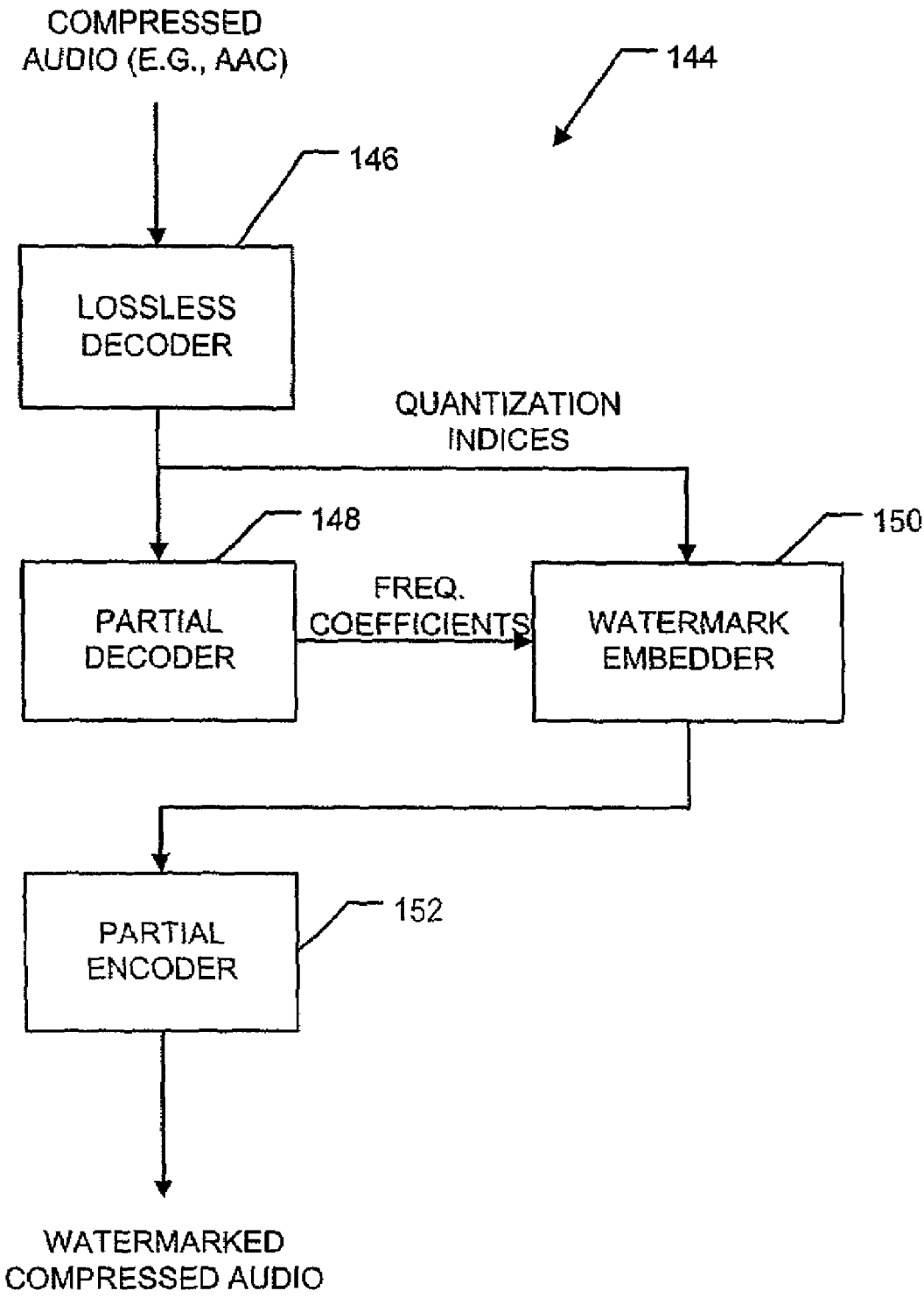
FIG. 6 is a flow chart of one configuration of an encoder adding watermarks to a compressed audio data stream.

In one configuration 144 and referring to FIG. 6, a watermark is added to a compressed audio signal, for example, an AAC signal. The compressed audio is applied to a lossless decoder 146, which produces an output that includes quantization indices. The output of the lossless decoder is applied to a partial decoder 148 which produces an output of frequency coefficients. The frequency coefficients and the quantization indices are input to a watermark embedder 150, the output of which provides the input to a partial encoder 152. The output of partial encoder 152 is data corresponding to watermarked compressed audio.

Figure 7:
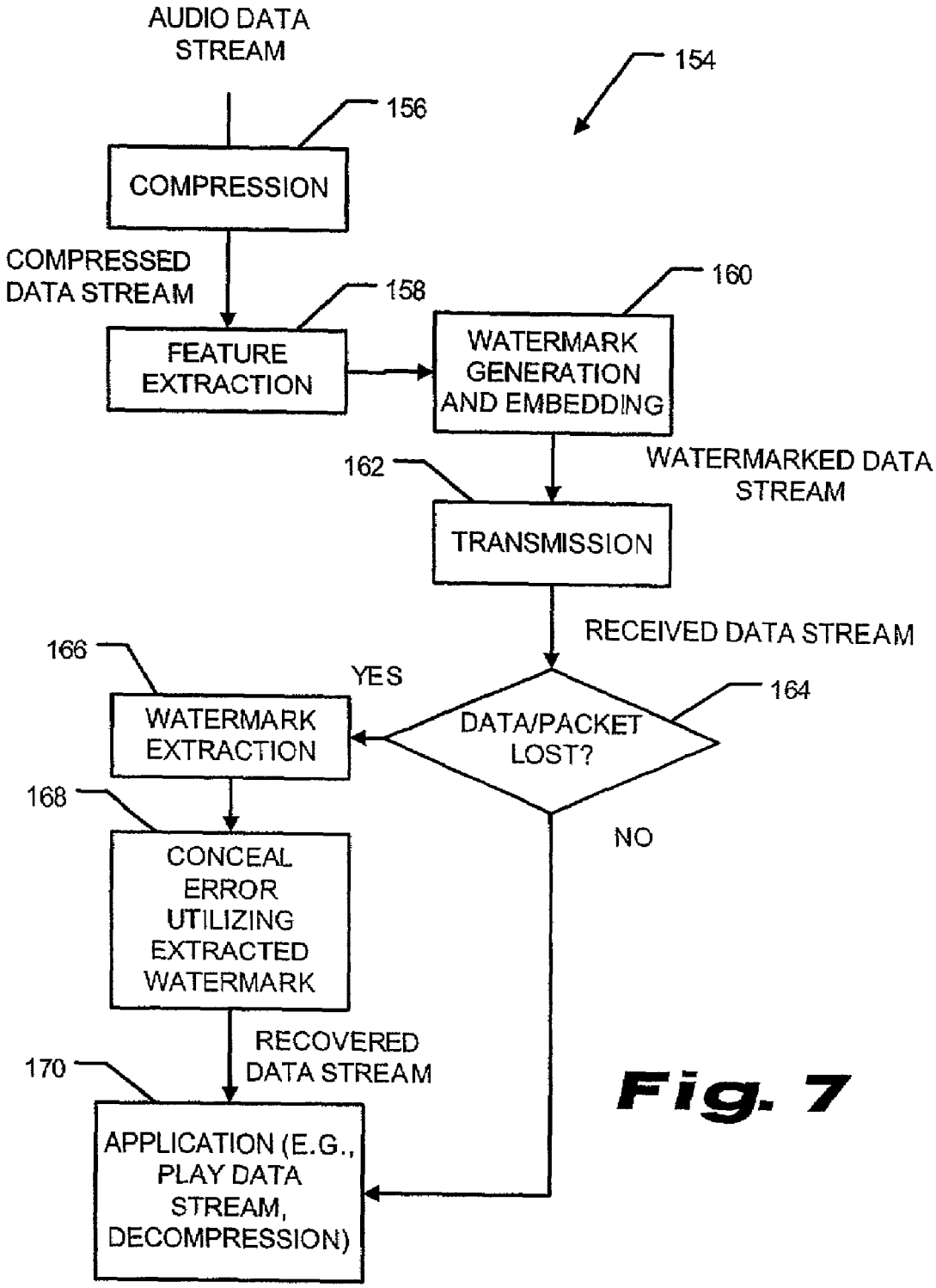
FIG. 7 is a flow chart of one configuration of a method for encoding and for decoding an audio data stream.

In yet another configuration 154 and referring to FIG. 7, an audio data stream is compressed 156 and the resulting compressed data stream is input to a feature extractor 158. The output of feature extractor 158 is input to a watermark generator and embedder 160 to produce a watermarked data stream. The watermarked data stream is transmitted 162 over a channel that may produce lost data or data packets in the received data stream, so a receiver receiving the received data stream determines 164 whether a data or a packet is lost. If no data/packet is lost, the data is sent to an application 170, such as an application to decompress and play a data stream. Otherwise, if a data/packet is lost, a watermark 166 is extracted, and the missing data or packet is concealed 168 utilizing the extracted watermark to produce a recovered data stream that is sent to application 170.

In another configuration similar to that shown in FIG. 7, the audio data stream is not compressed, and thus, compression 156 is omitted. In this configuration, the audio data stream is fed directly to feature extraction 158, and application 170 does not provide decompression that would otherwise be required.

Configurations of the present invention will thus be seen to provide audio data recovery by data hiding in the presence of missing blocks resulting from transmission channel errors. Because some amount of knowledge about the actual content of lost blocks is concealed within neighboring portions of the data stream, a lost packet can be acceptably recovered using hidden data concealed in the non-corrupted received data packets. Configurations of the present invention can be overlaid with other error control methods to further enhance error concealment in MPEG-2 AAC audio streams. Although configurations of the present invention are described in detail for MPEG-2 AAC audio files and streams, other configurations of the present invention can be applied to other media formats. For example, in one configuration, watermarking is used for error concealment in an original, uncompressed data stream.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for concealing errors in an audio signal containing a compressed audio stream, comprising:

digitally encoding the audio signal into a plurality of audio data packets representative of the audio signal;

determining a perceptually tolerable distortion limit for said audio packets using an heuristic model for perceptual control; and altering a value of at least one said audio packet by an amount less than said perceptually tolerable distortion limit utilizing information representative of a different said audio data packet, wherein using the heuristic model includes selecting audio data packet indices having magnitudes above a predetermined threshold and modifying a plurality of the indices by a predetermined value, thereby affecting perceptual control when an original perceptual model employed to compress the compressed audio stream is not available, wherein a plurality of said audio packets are altered by an amount less than said perceptually tolerable distortion, each alteration utilizing information representative of a different said audio packet than the audio packet being altered.

2. A method in accordance with claim 1 wherein said alteration comprises fragile watermarking.

3. A method in accordance with claim 2 wherein said alteration comprises least bit modulation (LBM).

4. A method in accordance with claim 1 wherein said encoded audio data packets comprise modulated discrete cosine transform (MDCT) coefficients.

5. A method in accordance with claim 4 wherein said altering a value of at least one said audio packet comprises modifying quantized indices of said encoded audio data packets.

6. A method in accordance with claim 4 wherein said alteration comprises modulo watermarking.

7. A method for concealing errors in an audio signal, comprising:

digitally encoding the audio signal into a plurality of audio data packets representative of the audio signal;

determining a perceptually tolerable distortion limit for said audio packets; and altering a value of at least one said audio packet by an amount less than said perceptually tolerable distortion limit utilizing information representative of a different said audio data packet, wherein a plurality of said audio packets are altered by an amount less than said perceptually tolerable distortion, each alteration utilizing information representative of a different said audio packet than the audio packet being altered, wherein said encoded audio data packets comprise modulated discrete cosine transform (MDCT) coefficients, wherein said coefficients include coefficients corresponding to a plurality of bands within a time frame and said encoded audio data packets comprise a plurality of time frames, and wherein, for a band i and a time frame n, a coefficient is written b[n,k], where $k \in K_i$ and $K_i$ is an index set of band i, and coefficient b[n,k] includes two least significant bits having an integer value of 0, 1, 2, or 3 written d[n,i], and further wherein said altering at least one audio data packet comprises:

determining indices $$c[n, i] = \text{argmin}_{c \in \{0,1,2,3\}} \sum_{k \in K_i} \left(b[n, k] - \hat{b}_c[n, k]\right)^2,$$

wherein $\hat{b}_0[n,k]=0$, $\hat{b}_1[n,k]=b[n-1,k]$, $\hat{b}_2[n,k]=b[n+1,k]$, and $$b_3[n, k] = \frac{1}{2}(b[n-1, k] + b[n+1, k]);$$

and $$\text{setting } d[n, i] = \begin{cases} 0, & \text{if } c[n-1, i] \in \{0,1\} \wedge c[n+1, i] \in \{0,2\}, \\ 1, & \text{if } c[n-1, i] \in \{2,3\} \wedge c[n+1, i] \in \{0,2\}, \\ 2 & \text{if } c[n-1, i] \in \{0,1\} \wedge c[n+1, i] \in \{1,3\}, \\ 3 & \text{if } c[n-1, i] \in \{2,3\} \wedge c[n+1, i] \in \{1,3\}. \end{cases}$$

8. A method for concealing errors in an audio signal, comprising:

digitally encoding the audio signal into a plurality of audio data packets representative of the audio signal;

determining a perceptually tolerable distortion limit for said audio packets; and altering a value of at least one said audio packet by an amount less than said perceptually tolerable distortion limit utilizing information representative of a different said audio data packet, wherein a plurality of said audio packets are altered by an amount less than said perceptually tolerable distortion, each alteration utilizing information representative of a different said audio packet than the audio packet being altered, wherein said encoded audio data packets comprise modulated discrete cosine transform (MDCT) coefficients, wherein said coefficients include coefficients are quantization indices corresponding to a plurality of bands within a time frame and said encoded audio data packets comprise a plurality of time frames, and wherein, for a band i and a time frame n, a quantization index is written q[n,k], where $k \in K_i$ and $K_i$ is an index set of band i, and coefficient b[n,k] includes least significant bits written d[n,i], and further wherein said determining a perceptually tolerable distortion limit comprises determining a number K of different embeddable values, and $l=\Sigma_{k \in K_i} q[n,k]-d[n,i] \bmod K$;

and further comprising:

selecting a lower limit $I_{min}$ in accordance with a minimum quantization index for which distortion can be tolerated and selecting an upper limit $I_{max}$ to prevent quantization indices from being outside a bound after modification;

and further wherein said altering at least one audio data packet comprises:

searching for l or K−l of said quantization indices having the largest magnitude from all said quantization indices that lie within a range $[I_{min}, I_{max}]$, depending upon whether $0 \leqq l < K/2$ or $K > l > K/2$, respectively;

when fewer than the searched for said quantization indices are found, leaving said found quantization indices unchanged, otherwise subtracting or adding 1 from each said found quantization index depending upon whether $0 \leqq l < K/2$ or $K > l > K/2$.

9. A method for concealing errors in an audio signal, comprising:

digitally encoding the audio signal into a plurality of audio data packets representative of the audio signal;

determining a perceptually tolerable distortion limit for said audio packets;

altering a value of at least one said audio packet by an amount less than said perceptually tolerable distortion limit utilizing information representative of a different said audio data packet, wherein a plurality of said audio packets are altered by an amount less than said perceptually tolerable distortion, each alteration utilizing information representative of a different said audio packet than the audio packet being altered, wherein said encoded audio data packets comprise modulated discrete cosine transform (MDCT) coefficients; and preselecting a frame offset k; and further wherein said altering at least one audio data packet comprises embedding a 1 or a 0 in a least significant bit of a coefficient in a frame n+k of a band j, depending upon whether $\Sigma_i(X_i^j(n)-X_i^j(n-1))^2 > \Sigma_i(X_i^j(n))^2$, where $X_i^j(n)$ represents an ith coefficient of a subband j in a frame n produced by said digital encoding of the audio data.

10. A method for concealing errors in an audio signal containing a compressed audio stream, comprising:

decoding a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit determined for said audio packets using an heuristic model for perceptual control;

determining that at least one said audio data packet is missing or unavailable from the digitally encoded audio signal;

extracting information representative of said missing or unavailable audio data packet from an alteration of at least one different, available audio data packet; and utilizing said extracted information to estimate said missing or unavailable audio data packet, wherein using the heuristic model includes selecting audio data packet indices having magnitudes above a predetermined threshold and modifying a plurality of the indices by a predetermined value, thereby affecting percentual control when an original perceptual model employed to compress the compressed audio stream is not available, wherein a plurality of said audio packets are altered by an amount less than said perceptually tolerable distortion, each alteration utilizing information representative of a different said audio packet than the audio packet being altered.

11. A method in accordance with claim 10 wherein more than one audio data packet is missing or unavailable, and said extracting and utilizing steps are iterated for each missing data packet.

12. A method in accordance with claim 11 wherein said extracted information comprises a fragile watermark.

13. A method in accordance with claim 12 wherein said extracted information comprises least bit modulation (LBM).

14. A method in accordance with claim 11 wherein said altered audio data packets comprise altered modulated discrete cosine transform (MDCT) coefficients.

15. A method for concealing errors in an audio signal, comprising:

decoding a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit;

determining that at least one said audio data packet is missing or unavailable from the digitally encoded audio signal;

extracting information representative of said missing or unavailable audio data packet from an alteration of at least one different, available audio data packet; and utilizing said extracted information to estimate said missing or unavailable audio data packet, wherein more than one audio data packet is missing or unavailable, and said extracting and utilizing steps are iterated for each missing data packet, wherein said altered audio data packets comprise altered modulated discrete cosine transform (MDCT) coefficients, wherein said coefficients include coefficients corresponding to a plurality of bands within a time frame and said encoded audio data packets comprise a plurality of time frames, and wherein, for a band i and a time frame n, said altered audio data packets comprise a coefficient written b[n,k], where $k \in K_i$ and $K_i$ is an index set of band i, wherein coefficient b[n,k] includes two least significant bits having an integer value of 0, 1, 2, or 3 written d[n,i], and further wherein d[n,i] is altered so that $$d[n,i] = \begin{cases} 0, & \text{if } c[n-1,i] \in \{0,1\} \wedge c[n+1,i] \in \{0,2\}, \\ 1, & \text{if } c[n-1,i] \in \{2,3\} \wedge c[n+1,i] \in \{0,2\}, \\ 2 & \text{if } c[n-1,i] \in \{0,1\} \wedge c[n+1,i] \in \{1,3\}, \\ 3 & \text{if } c[n-1,i] \in \{2,3\} \wedge c[n+1,i] \in \{1,3\}, \end{cases}$$

wherein $$c[n,i] = \operatorname{argmin}_{c \in \{0,1,2,3\}} \sum_{k \in K_i} \left(b[n,k] - \hat{b}_c[n,k]\right)^2,$$

and $\hat{b}_0[n,k]=0$, $\hat{b}_1[n,k]=b[n-1,k]$, $\hat{b}_2[n,k]=b[n+1,k]$, and $$\hat{b}_3[n,k] = \frac{1}{2}\left(b[n-1,k] + b[n+1,k]\right);$$

and further wherein:

said extracting information representative of said missing or unavailable audio data packet comprises extracting d[n,i] for a plurality of time frames n; and said utilizing said extracted information to estimate said missing or unavailable audio data packet comprises utilizing bits of said extracted d[n,i] to determine whether to estimate a missing or unavailable coefficient utilizing a neighboring time frame.

16. A method for concealing errors in an audio signal, comprising:

decoding a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit;

determining that at least one said audio data packet is missing or unavailable from the digitally encoded audio signal;

extracting information representative of said missing or unavailable audio data packet from an alteration of at least one different, available audio data packet; and utilizing said extracted information to estimate said missing or unavailable audio data packet, wherein more than one audio data packet is missing or unavailable, and said extracting and utilizing steps are iterated for each missing data packet, wherein said altered audio data packets comprise altered modulated discrete cosine transform (MDCT) coefficients, wherein said coefficients include coefficients that are quantization indices corresponding to a plurality of bands with a time frame and said encoded audio data packets comprise a plurality of time frames, and wherein, for a band i and a time frame n, a quantization index is written q[n,k], where $k \in K_i$ and $K_i$ is an index set of band i, and coefficient b[n,k] includes least significant bits written d[n,i], and further wherein said predetermined perceptually tolerable distortion limit includes K different embeddable values, and $l=\sum_{k \in K_i} q[n,k]-d[n,i] \bmod K$;

and further wherein said extracting information representative of said missing or unavailable audio data packet comprises decoding $\hat{d}[n,i]$ as $$\sum_{k \in K_i} q[n, k] \bmod K.$$

17. A method for concealing errors in an audio signal, comprising:

decoding a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit;

determining that at least one said audio data packet is missing or unavailable from the digitally encoded audio signal;

extracting information representative of said missing or unavailable audio data packet from an alteration of at least one different, available audio data packet; and utilizing said extracted information to estimate said missing or unavailable audio data packet, wherein more than one audio data packet is missing or unavailable, and said extracting and utilizing steps are iterated for each missing data packet, wherein said altered audio data packets comprise altered modulated discrete cosine transform (MDCT) coefficients, wherein, for a preselected frame offset k; said altered data packets comprise an embedded 1 or a 0 in a least significant bit B(j) of a coefficient in a frame n+k of a band j, depending upon whether $\Sigma_i(X_i^j(n)-X_i^j(n-1))^2 > \Sigma_i(X_i^j(n))^2$, where $X_i^j(n)$ represents an ith coefficient of a subband I in a frame n produced by said digital encoding of the audio data, wherein said least significant bits B(j) are embedded for each j from 1 to J, wherein j is the band in which the bit is embedded, and J is the number of bands;

and for a lost frame n, said extracting information representative of said missing or unavailable audio data packet comprises extracting, from a frame n+k, embedded bits B(j) for j=1,J; and said utilizing said extracted information comprises estimating coefficient value $X_i^j(n)$ as either $X_i^j(n-1)$ or 0, depending upon the extracted embedded bits.

18. An apparatus for concealing errors in an audio signal containing a compressed audio stream, said apparatus configured to:

digitally encode the audio signal into a plurality of audio data packets representative of the audio signal; and utilizing a determined perceptually tolerable distortion limit for said audio packets, alter a value of at least one said audio packet by an amount less than said perceptually tolerable distortion limit utilizing information representative of a different said audio data packet, wherein an heuristic model is used for perceptual control to determine the perceptually tolerable distortion limit for said audio packets, wherein using the heuristic model includes selecting audio data packet indices having magnitudes above a predetermined threshold and modifying a plurality of the indices by a predetermined value, thereby affecting perceptual control when an original perceptual model employed to compress the compressed audio stream is not available configuring to alter a plurality of said audio packets by an amount within said perceptually tolerable distortion, and for each said alteration, utilizing information representative of a different said audio packet than the audio packet being altered.

19. An apparatus in accordance with claim 18 wherein said alteration comprises a fragile watermarking.

20. An apparatus in accordance with claim 19 wherein said alteration comprises least bit modulation (LBM).

21. An apparatus in accordance with claim 18 configured to encode said audio data packets as data including modulated discrete cosine transform (MDCT) coefficients.

22. An apparatus for concealing errors in an audio signal, said apparatus configured to:

digitally encode the audio signal into a plurality of audio data packets representative of the audio signal;

utilizing a determined perceptually tolerable distortion limit for said audio packets, alter a value of at least one said audio packet by an amount less than said perceptually tolerable distortion limit utilizing information representative of a different said audio data packet;

alter a plurality of said audio packets by an amount within said perceptually tolerable distortion;

for each said alteration, utilize information representative of a different said audio packet than the audio packet being altered; and encode said audio data packets as data including modulated discrete cosine transform (MDCT) coefficients, wherein said coefficients include coefficients correspond to a plurality of bands within a time frame and said encoded audio data packets comprise a plurality of time frames, and wherein, for a band i and a time frame n, a coefficient is written b[n,k], where $k \in K_i$ and $K_i$ is an index set of band i, and coefficient b[n,k] includes two least significant bits having an integer value of 0, 1, 2, or 3 written d[n,i], and further wherein to alter at least one audio data packet, said apparatus is configured to:

determine indices $$c[n, i] = \operatorname{argmin}_{c \in \{0,1,2,3\}} \sum_{k \in K_i} \left(b[n, k] - \hat{b}_c[n, k]\right)^2,$$

wherein $\hat{b}_0[n,k]=0$, $\hat{b}_1[n,k]=b[n-1,k]$, $\hat{b}_2[n,k]=b[n+1,k]$, and $$\hat{b}_3[n, k] = \frac{1}{2}\left(b[n-1, k] + b[n+1, k]\right);$$

and $$\text{set } d[n, i] = \begin{cases} 0, & \text{if } c[n-1, i] \in \{0, 1\} \wedge c[n+1, i] \in \{0, 2\}, \\ 1, & \text{if } c[n-1, i] \in \{2, 3\} \wedge c[n+1, i] \in \{0, 2\}, \\ 2 & \text{if } c[n-1, i] \in \{0, 1\} \wedge c[n+1, i] \in \{1, 3\}, \\ 3 & \text{if } c[n-1, i] \in \{2, 3\} \wedge c[n+1, i] \in \{1, 3\}. \end{cases}$$

23. An apparatus for concealing errors in an audio signal, said apparatus configured to:

digitally encode the audio signal into a plurality of audio data packets representative of the audio signal;

utilizing a determined perceptually tolerable distortion limit for said audio packets, alter a value of at least one said audio packet by an amount less than said perceptually tolerable distortion limit utilizing information representative of a different said audio data packet;

alter a plurality of said audio packets by an amount within said perceptually tolerable distortion;

for each said alteration, utilize information representative of a different said audio packet than the audio packet being altered; and encode said audio data packets as data including modulated discrete cosine transform (MDCT) coefficients, wherein said coefficients include coefficients that are quantization indices corresponding to a plurality of bands within a time frame and said encoded audio data packets comprise a plurality of time frames, and wherein, for a band i and a time frame n, a quantization index is written q[n,k], where $k \in K_i$ and $K_i$ is an index set of band i, and coefficient b[n,k] includes least significant bits written d[n,i], and further having a selected number K of different embeddable values, where $l \equiv \Sigma_{k \in K_i} q[n,k] - d[n,i] \bmod K$; a lower limit $I_{min}$ in selected accordance with a minimum quantization index for which distortion can be tolerated; and an upper limit $I_{max}$ to prevent quantization indices from being outside a bound after modification;

and further wherein to alter said at least one audio data packet, said apparatus is configured to:

search for l or k−l of said quantization indices having the largest magnitude from all said quantization indices that lie within a range $[I_{min}, I_{max}]$, depending upon whether $0 \leqq l < K/2$ or $K > l > K/2$, respectively; and when fewer than the searched for said quantization indices are found, leave said found quantization indices unchanged, otherwise subtract or add 1 from each said found quantization index depending upon whether $0 \leqq l < K/2$ or $K > l > K/2$.

24. An apparatus for concealing errors in an audio signal, said apparatus configured to:

digitally encode the audio signal into a plurality of audio data packets representative of the audio signal;

utilizing a determined perceptually tolerable distortion limit for said audio packets, alter a value of at least one said audio packet by an amount less than said perceptually tolerable distortion limit utilizing information representative of a different said audio data packet;

alter a plurality of said audio packets by an amount within said perceptually tolerable distortion;

for each said alteration, utilize information representative of a different said audio packet than the audio packet being altered; and encode said audio data packets as data including modulated discrete cosine transform (MDCT) coefficients, wherein to alter at least one audio data packet, said apparatus is configured to embed a 1 or a 0 in a least significant bit of a coefficient in a frame n+k of a band j, depending upon whether $\Sigma_i(X_i^j(n)-X_i^j(n-1))^2 > \Sigma_i(X_i^j(n))^2$, wherein $X_i^j(n)$ represents an ith coefficient of a subband j in a frame n produced by said digital encoding of the audio data; and further wherein k is a preselected frame offset.

25. An apparatus for concealing errors in an audio signal containing a compressed audio stream, said apparatus configured to:

decode a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit determined for said audio packets using an heuristic model for perceptual control;

determine when at least one said audio data packet is missing or unavailable from the digitally encoded audio signal;

extract information representative of said missing or unavailable audio data packet from an alteration of at least one different, available audio data packet; and utilize said extracted information to estimate said missing or unavailable audio data packet, wherein using the heuristic model includes selecting audio data packet indices having magnitudes above a predetermined threshold and modifying a plurality of the indices by a predetermined value, thereby affecting perceptual control when an original perceptual model employed to compress the compressed audio stream is not available configuring to alter a plurality of said audio packets by an amount within said perceptually tolerable distortion, and for each said alteration, utilizing information representative of a different said audio packet than the audio packet being altered.

26. An apparatus in accordance with claim 25 wherein more than one audio data packet is missing or unavailable, said apparatus configured to iterate said extracting and utilizing for each missing data packet.

27. An apparatus in accordance with claim 26 configured to extract a fragile watermark.

28. An apparatus in accordance with claim 27 configured to extract least bit modulation (LBM).

29. An apparatus in accordance with claim 26 configured to decode altered audio data packets comprising altered modulated discrete cosine transform (MDCT) coefficients.

30. An apparatus for concealing errors in an audio signal, said apparatus configured to:

decode a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit;

determine when at least one said audio data packet is missing or unavailable from the digitally encoded audio signal;

extract information representative of said missing or unavailable audio data packet from an alteration of at least one different, available audio data packet;

utilize said extracted information to estimate said missing or unavailable audio data packet;

wherein more than one audio data packet is missing or unavailable, said apparatus configured to iterate said extracting and utilizing for each missing data packet extract a fragile watermark; and decode altered audio data packets comprising altered modulated discrete cosine transform (MDCT) coefficients, wherein said coefficients include coefficients corresponding to a plurality of bands within a time frame and said encoded audio data packets comprise a plurality of time frames, and wherein, for a band i and a time frame n, said altered audio data packets comprise a coefficient written b[n,k], where $k \in K_i$ and $K_i$ is an index set of band i, wherein coefficient b[n,k] includes two least significant bits having an integer value of 0, 1, 2, or 3 written d[n,i], and further wherein d[n,i] is altered so that $$d[n,i] = \begin{cases} 0, & \text{if } c[n-1,i] \in \{0,1\} \wedge c[n+1,i] \in \{0,2\}, \\ 1, & \text{if } c[n-1,i] \in \{2,3\} \wedge c[n+1,i] \in \{0,2\}, \\ 2 & \text{if } c[n-1,i] \in \{0,1\} \wedge c[n+1,i] \in \{1,3\}, \\ 3 & \text{if } c[n-1,i] \in \{2,3\} \wedge c[n+1,i] \in \{1,3\}, \end{cases}$$

where $$c[n,i] = \text{argmin}_{c \in \{0,1,2,3\}} \sum_{k \in K_i} \left(b[n,k] - \hat{b}_c[n,k]\right)^2,$$

and $\hat{b}_0[n,k]=0$, $\hat{b}_1[n,k]=b[n-1,k]$, $\hat{b}_2[n,k]=b[n+1,k]$, and $$\hat{b}_3[n,k] = \frac{1}{2}\left(b[n-1,k] + b[n+1,k]\right);$$

and further wherein:

to extract information representative of said missing or unavailable audio data packet, said apparatus is configured to extract d[n,i] for a plurality of time frames n; and to utilize said extracted information to estimate said missing or unavailable audio data packet, said apparatus is configured to utilize bits of said extracted d[n,i] to determine whether to estimate a missing or unavailable coefficient utilizing a neighboring time frame.

31. An apparatus for concealing errors in an audio signal, said apparatus configured to:

decode a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit;

determine when at least one said audio data packet is missing or unavailable from the digitally encoded audio signal;

extract information representative of said missing or unavailable audio data packet from an alteration of at least one different, available audio data packet;

utilize said extracted information to estimate said missing or unavailable audio data packet;

wherein more than one audio data packet is missing or unavailable, said apparatus configured to iterate said extracting and utilizing for each missing data packet extract a fragile watermark; and decode altered audio data packets comprising altered modulated discrete cosine transform (MDCT) coefficients, wherein said coefficients include coefficients that are quantization indices corresponding to a plurality of bands within a time frame and said encoded audio data packets comprise a plurality of time frames, and wherein, for a band i and a time frame n, a quantization index is written q[n,k], where $k \in K_i$ is an index set of band i, and coefficient b[n,k] includes least significant bits written d[n,i], and further wherein said predetermined perceptually tolerable distortion limit includes K different embeddable values, and $1=\Sigma_{k \in K_i} q[n,k]-d[n,i] \bmod K$;

And further wherein to extract information representative of said missing or unavailable audio data packet, said apparatus is configured to decode $\hat{d}[n,i]$ as $$\sum_{k \in K_i} q[n,k] \bmod K.$$

32. An apparatus for concealing errors in an audio signal, said apparatus configured to:

decode a digitally encoded audio signal, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit;

determine when at least one said audio data packet is missing or unavailable from the digitally encoded audio signal;

extract information representative of said missing or unavailable audio data packet from an alteration of at least one different, available audio data packet;

utilize said extracted information to estimate said missing or unavailable audio data packet;

wherein more than one audio data packet is missing or unavailable, said apparatus configured to iterate said extracting and utilizing for each missing data packet extract a fragile watermark; and decode altered audio data packets comprising altered modulated discrete cosine transform (MDCT) coefficients, wherein, for a preselected frame offset k; said altered data packets comprise an embedded 1 or a 0 in a least significant bit B(j) of a coefficient in a frame n+k of a band j, depending upon whether $\Sigma_i(X_i^j(n)-X_i^j(n-1))^2 > \Sigma_i(X_i^j(n))^2$, where $X_i^j(n)$ represents an ith coefficient of a subband j in a frame n produced by said digital encoding of the audio data, wherein said least significant bits B(j) are embedded for each j from 1 to J, wherein j is the band in which the bit is embedded, and J is the number of bands;

and for a lost frame n, to extract information representative of said missing or unavailable audio data packet, said apparatus is configured to extract, from a frame n+k, embedded bits B(j) for j=1, J; and to utilize said extracted information, said apparatus is configured to estimate coefficient value $X_i^j(n)$ as either $X_i^j(n-1)$ or 0, depending upon the extracted embedded bits.

33. A machine readable medium having recorded thereon instructions configured to instruct a computer to:

digitally encode an audio signal containing a compressed audio stream into a plurality of audio data packets representative of the audio signal; and utilizing a determined perceptually tolerable distortion limit for said audio packets, alter a value of at least one said audio packet by an amount less than said perceptually tolerable distortion limit utilizing information representative of a different said audio data packet, wherein an heuristic model is used for perceptual control to determine the perceptually tolerable distortion limit for said audio packets, wherein using the heuristic model includes selecting audio data packet indices having magnitudes above a predetermined threshold and modifying a plurality of the indices by a predetermined value, thereby affecting perceptual control when an original perceptual model employed to compress the compressed audio stream is not available, wherein a plurality of said audio packets are altered by an amount less than said perceptually tolerable distortion, each alteration utilizing information representative of a different said audio packet than the audio packet being altered.

34. A machine readable medium having recorded thereon instructions configured to instruct a computer to:

decode a digitally encoded audio signal containing a compressed audio stream, wherein said digitally encoded audio signal includes a plurality of audio data packets representative of the audio signal, and said plurality of audio data packets includes a plurality of altered audio data packets; wherein each said altered audio data packet comprises an alteration indicative of information representative of a different said audio data packet, and each said alteration is limited to a predetermined perceptually tolerable distortion limit predetermined for said audio packets using an heuristic model for perceptual control;

determine when at least one said audio data packet is missing or unavailable from the digitally encoded audio signal;

extract information representative of said missing or unavailable audio data packet from an alteration of at least one different, available audio data packet; and utilize said extracted information to estimate said missing or unavailable audio data packet, wherein a plurality of said audio packets are altered by an amount less than said perceptually tolerable distortion, each alteration utilizing information representative of a different said audio packet than the audio packet being altered.

* * * * *

UNITED STATES PATENT AND TRADEMARK OFFICE

CERTIFICATE OF CORRECTION

PATENT NO. : 7,047,187 B2 
APPLICATION NO. : 10/083886
DATED : May 16, 2006
INVENTOR(S) : Szeming Cheng et al.

It is certified that error appears in the above-identified patent and that said Letters Patent is hereby corrected as shown below:

Column 11, Line 28, Claim 7:
the first "b" should be -- $\hat{B}$ --
Column 11, Line 28, Claim 7:
"}" should be --]--
Column 13, Line 2, Claim 10:
"percentual" should be --perceptual--
Column 14, Line 1, Claim 15:
"wherein" should be --where--
Column 15, Line 41, Claim 17:
"l" should be --j--
Column 17, Line 26, Claim 23:
"≡" should be -- = --
Column 17, Line 26, Claim 23:
"$l$" should be --i--

Signed and Sealed this

Twenty-sixth Day of December, 2006

JON W. DUDAS
*Director of the United States Patent and Trademark Office*